US010004966B1

(12) United States Patent
Purcey

(10) Patent No.: US 10,004,966 B1
(45) Date of Patent: Jun. 26, 2018

(54) TOWEL TRAINER

(71) Applicant: David K Purcey, Frisco, TX (US)

(72) Inventor: David K Purcey, Frisco, TX (US)

( * ) Notice: Subject to any disclaimer, the term of this patent is extended or adjusted under 35 U.S.C. 154(b) by 0 days. days.

(21) Appl. No.: 14/708,441

(22) Filed: May 11, 2015

(51) Int. Cl.
*A63B 69/00* (2006.01)

(52) U.S. Cl.
CPC .. *A63B 69/0002* (2013.01); *A63B 2069/0006* (2013.01); *A63B 2208/0204* (2013.01)

(58) Field of Classification Search
CPC ..... A63H 27/00; A63B 67/06; A63B 43/00
USPC ..... 473/451, 570, 585, 423, 424, 146, 147, 473/422; 446/46
See application file for complete search history.

(56) References Cited

U.S. PATENT DOCUMENTS 5,230,682 A * 7/1993 Myers ..... A63B 21/0004 473/576
8,562,450 B2 * 10/2013 Gormley ..... A63B 43/007 473/146
2006/0217027 A1 * 9/2006 Martuccio ..... A41D 13/0015 446/46
2007/0105663 A1 * 5/2007 Farnsworth ..... A63B 15/00 473/422
2013/0109513 A1 * 5/2013 Fernandez ..... A63B 67/06 473/585
2015/0182810 A1 * 7/2015 Thurman ..... A63B 43/004 473/570

* cited by examiner

*Primary Examiner* — Gene Kim
*Assistant Examiner* — Christopher Glenn
(74) *Attorney, Agent, or Firm* — Jeffrey Roddy

(57) ABSTRACT

A towel trainer for use in drills for improving pitching mechanics includes a tail portion that transitions to a handle portion which is bulbous, and, a band resides between the head and tail portions which provides a pronounced "snapping" effect when a towel drill is performed correctly. The towel trainer may include a motion sensing circuit and audible alerts to notify a trainee of proper or improper body mechanics.

8 Claims, 12 Drawing Sheets

FIG.7
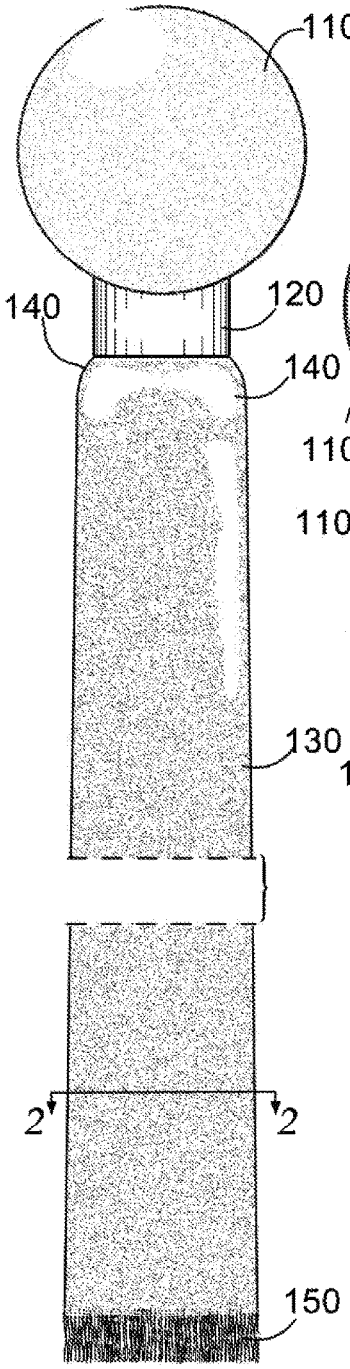
FIG.9
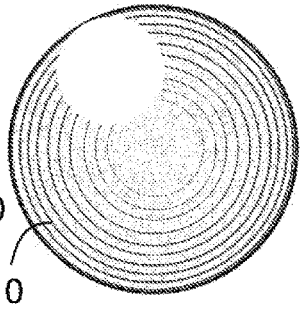
FIG.8
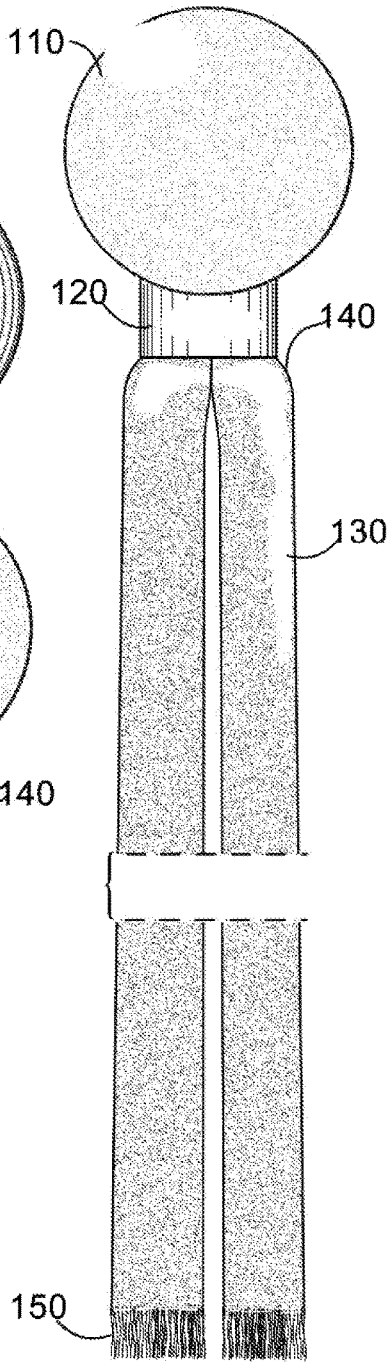
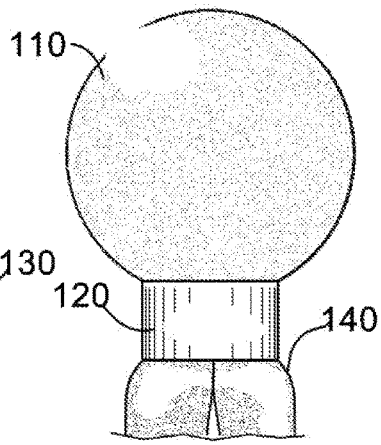
FIG.8a

FIG.17
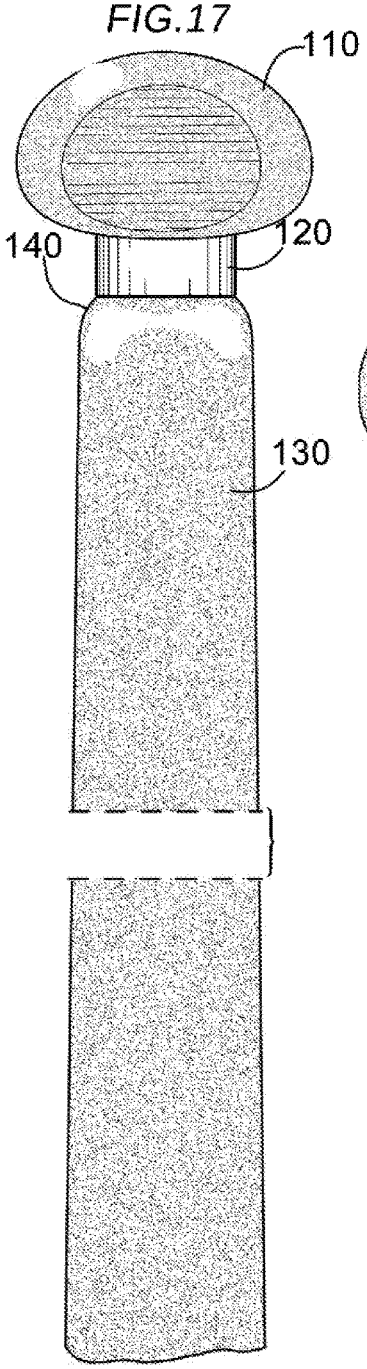
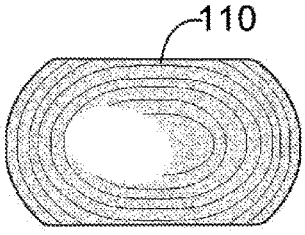
FIG.19
FIG.18
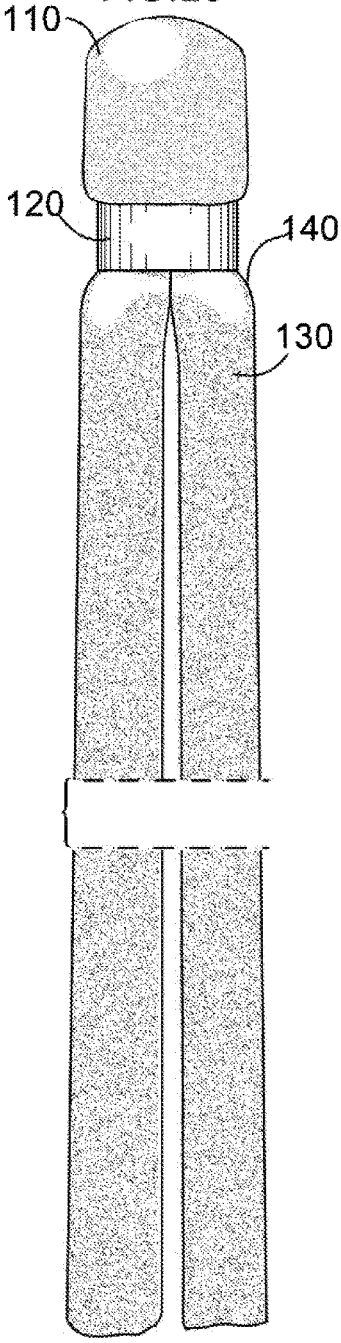

140
200
130

200
200

200

200

200
201

220
110
111
120
140

200
140
120
130
140

110
114
200
200
120
140
130

200

200
114

115
114
120
140

115
114
120
140
130

FIG.33
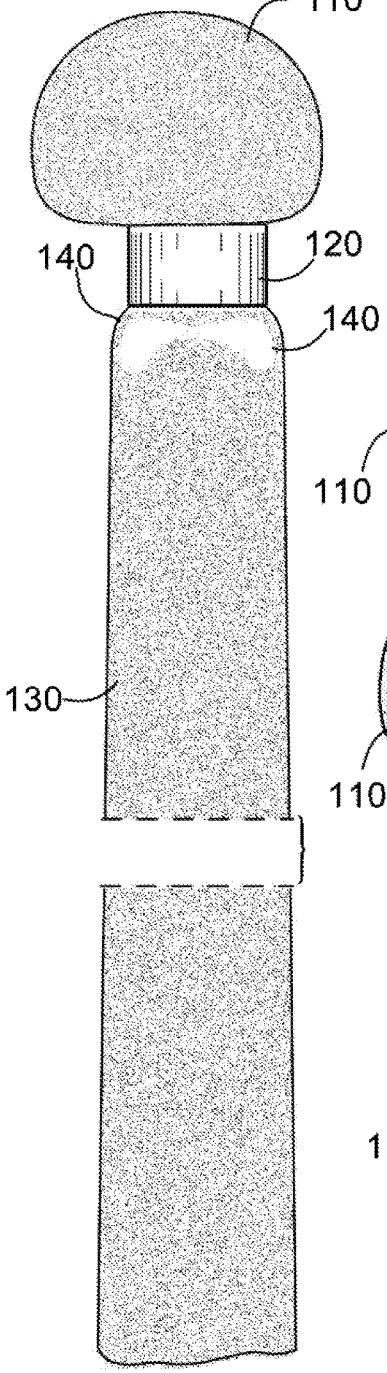
FIG.34
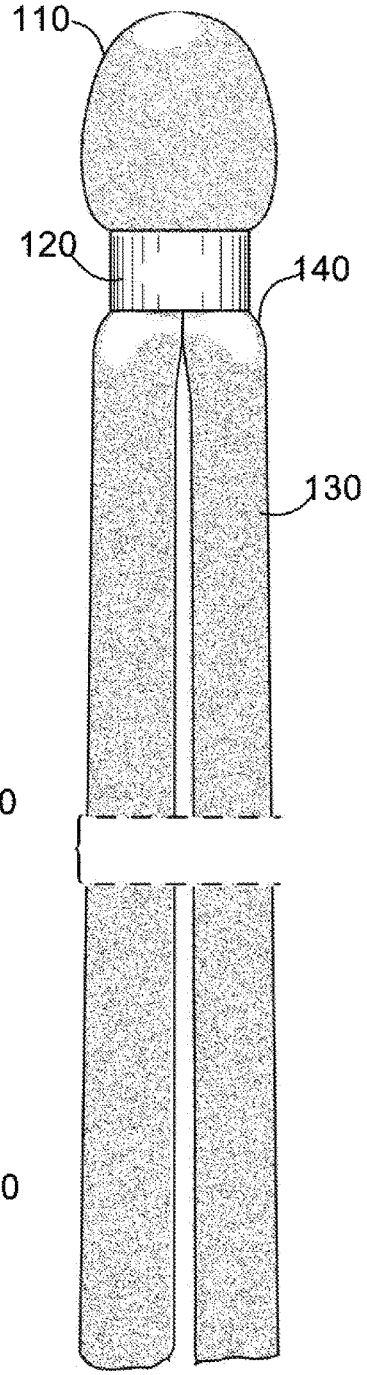
FIG.35
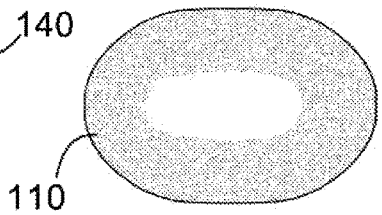
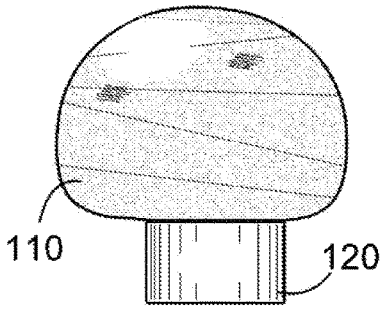
FIG.36
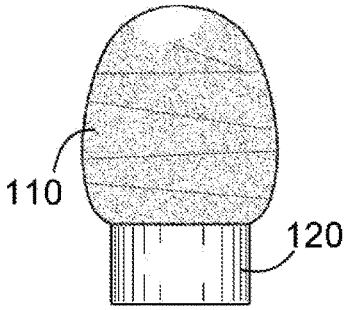
FIG.37

FIG.38
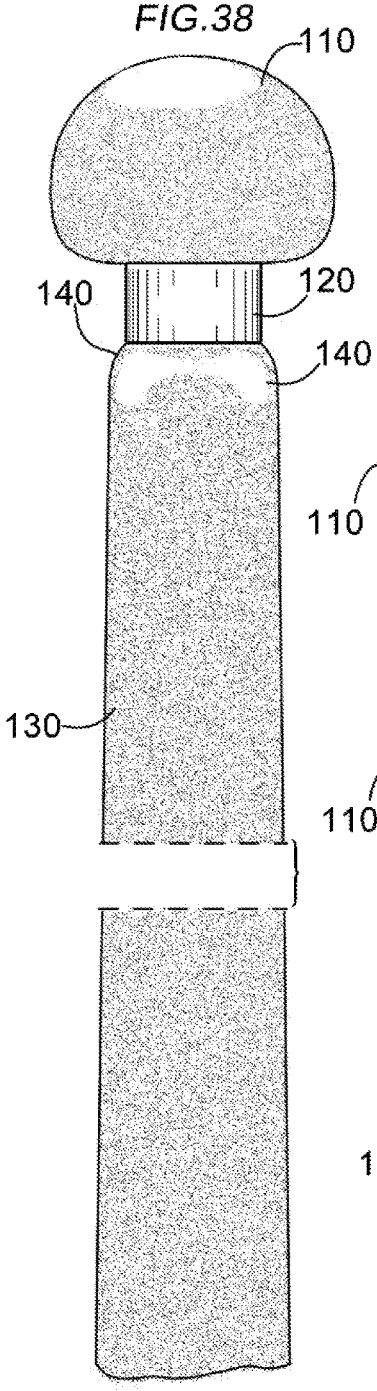
FIG.39
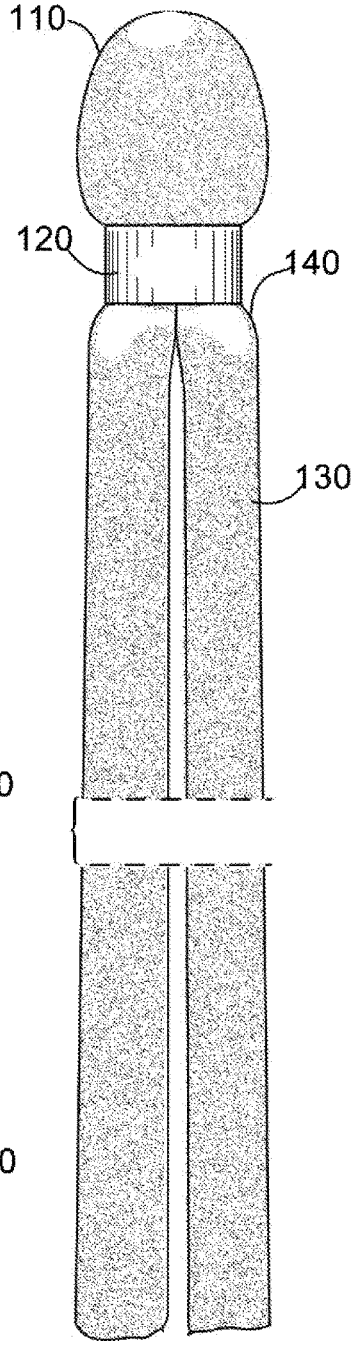
FIG.40
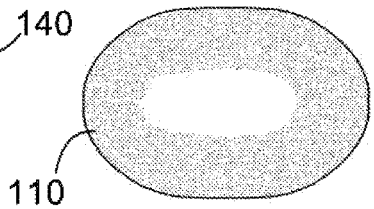
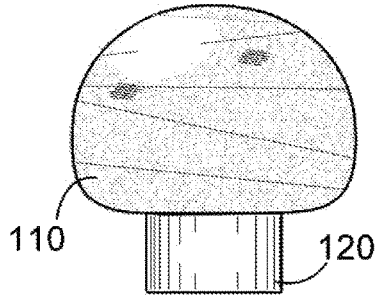
FIG.41
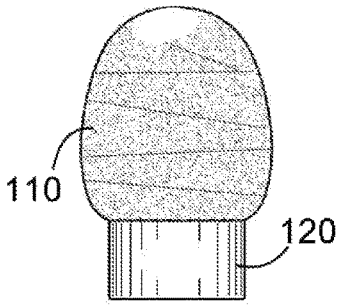
FIG.42

110
140
120
140
130

110

130
130

130

130

130

110
120
140
130

TOWEL TRAINER

FIELD OF THE INVENTION

This invention relates to the field of athletic training, and more particularly, to devices and methods for baseball pitching practice.

BACKGROUND OF THE INVENTION

"Dry work" or "dry mechanics" is a term used to describe pitching practice exercise designed to improve muscle memory, feel and reliable repetition without actually pitching the ball which can strain the arm."Towel drills" are a subset of dry work where a pitcher uses a towel to simulate the motions of pitching a ball. One goal of towel drilling is to snap the towel during the simulated pitching motion providing instant feedback at a point of release that corresponds to the actual point of release for a thrown ball. Another goal is to reinforce proper timing of a pitcher's stride in relation to his/her torso twist. In order to perform a towel drill, a hand towel is folded lengthwise and then transversely folded with equal ends of typically 8 to 12 inches. The middle finger of the pitching hand is placed through the bend so that the curve of the bend is on the palm side of the hand. One popular exercise is to grip a hand towel between a thumb and middle finger of a throwing hand, the trainee strings forward, then takes five additional steps forward. A second person places a target at belly button height of the trainee (five steps in front of the trainee's stride). During the stretch delivery, the trainee snaps the towel to hit the target. Any shift in posture by the trainee will result in a missed target. Rotating too early will also result in the trainer being short of the target. The foregoing exercise encourages late rotation of the trunk which is desirable trait in pitching mechanics.

Although many coaches encourage towel drills, one criticism of the practice is that a towel can never feel like a baseball. The way a towel is held, the weight, etc., differ from a baseball. What is needed is a training apparatus that cooperates with traditional towel drill exercises, but provides a more realistic feel that will not distract and encourage proper body mechanics when performing the drill.

It would be desirable to provide a towel trainer that has a handle portion that substitutes for a ball, and a tail portion that is able to snap when the forward traveling arm reaches a release moment.

It would be desirable to provide a towel trainer having different handle configurations to in order to adapt to pitcher preferences.

It would be further desirable to include a means for tracking the position and speed of the trainer during dry training.

It would be especially desirable if readily available hand towels were useable in embodiments of the invention.

SUMMARY

The present invention is directed to a towel trainer with a handle portion that at least in volume, approximates more closely the feel of a baseball. The handle or head portion of the trainer is bulbous, and a band, which is typically pliant, resides medially between head and tail portions. While, typically, the tail portion is formed from a common terry cloth hand towel such as are found in baseball clubhouses, other materials will suggest themselves to those having skill in the art and benefit of this disclosure. Embodiments of this invention are capable of use with any known towel drill.

Embodiments of a towel trainer disclosed herein provides haptic feedback that more closely approximates the feel of a hand held ball, while still retaining the positive features of towel drills; e.g., low stress to the pitching arm, permitting numerous repetitions to ingrain muscle memory, and, the "popping" sound of the tail when body mechanics are correct.

In some embodiments of the present invention, a motion sensor; e.g., an accelerometer sensor circuit, may be inserted into the head of the towel trainer to track the motion of the "ball". It is conceivable that data may be logged to memory on the circuit and accessed through a port. Likewise, an accelerometer may be paired with a radio transmitter to stream live pitching mechanics data to a computing device or display, or, may be stored or streamed to a mobile device; e.g., smart phone, or other personal computing device. Many accelerometer circuits are known that would be suitable for use with the towel trainer. One such wireless accelerometer is the subject of: Cochran et al., Wireless Accelerometer ECE 682 Dynamic Acceleration. Ohio State University 2009. Future Electronics of Pointe-Claire, Quebec also markets a number of accelerometers and chips for various applications. It is also possible that such a circuit include an audible sound such as a tone, cooperating with an accelerometer and circuit be employed to alert a user of body movement outside accepted norms/parameters, or conversely, body movement within accepted norms/parameters. The audible sound may vary in length, volume or other tonal quality according to how close a user is to a preset standard. One way to accomplish this is with a towel trainer having an on-board accelerometer that tracks motion, is to "lock in" a particular pitching motion, e.g., by pressing a button on the handle, or sending a wireless signal to the accelerometer circuit for it to "remember" an immediately prior motion which becomes a permanent or re-settable standard as desired. When a user diverges from the standard, a tone may be emitted from the towel trainer that may vary in tonal characteristics based on a user's nearness to the standard. US Pat. Pub. 20130324009 by Pascale descibes an accelerometer component for sensing movement in more than one direction and a sound emitting means responsive to the sensed movement.

Factors and Aspects of the Invention

First, the inventor is not aware of an existing towel trainers that include a handle approximating the feel of a held baseball, and include a gripping band and tail like the present invention.

Second, embodiments of the present invention can include the incorporation of a typical clubhouse hand towel.

Third, embodiments of the present invention can possess different handle shapes and handle weights.

Fourth, embodiments of the present invention can be fully assembled, or provided in a kit form.

There is a need for a towel trainer that provides haptic feedback that more closely approximates that of an actual baseball. Such a trainer will improve mechanics because it will better simulate the feel of a baseball, and discourage sloppy follow through, which can reinforce bad pitching habits.

The foregoing and other objects, features, and advantages of the invention will become more apparent from the following detailed description, which proceeds with reference to the accompanying figures wherein the scale depicted is approximate.

BRIEF DESCRIPTION OF THE DRAWING FIGURES

FIG. 7 shows a first side view of an embodiment according to the present invention;

FIG. 8 shows a second side view of the embodiment of (FIG. 7);

Figure 1:
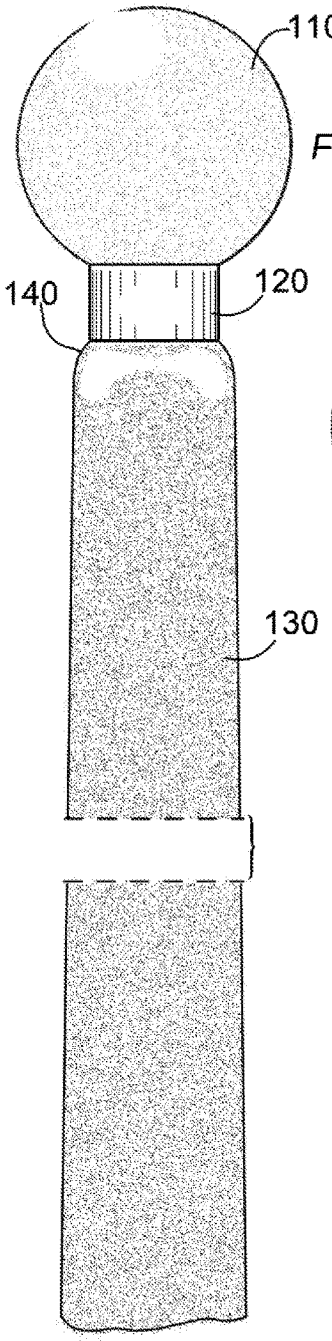
FIG. 1 shows a first side view of an embodiment according to the present invention.
Figure 2:
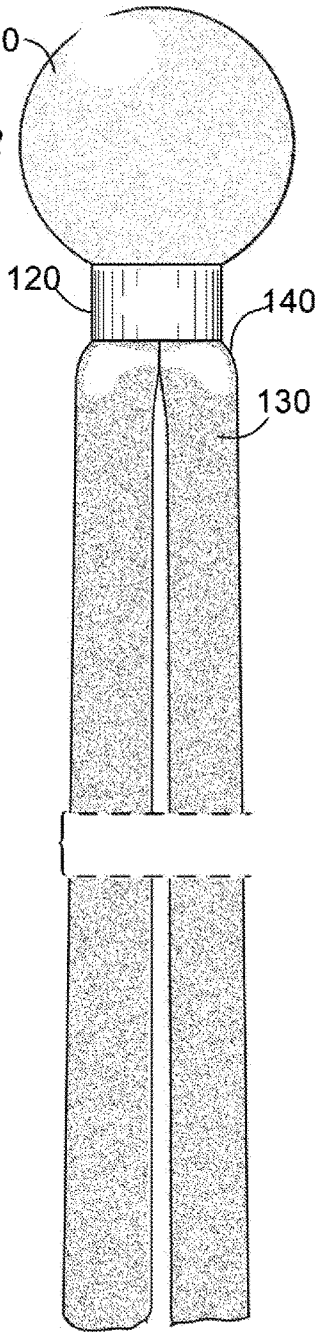
FIG. 2 shows a second side view of the embodiment of (FIG. 1)
Figure 3:
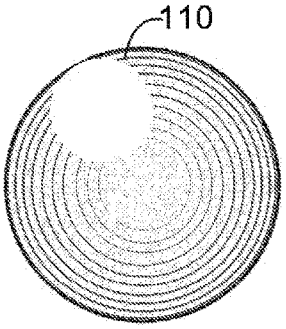
FIG. 3 shows an end view of the embodiment of (FIG. 1)
Figure 4:
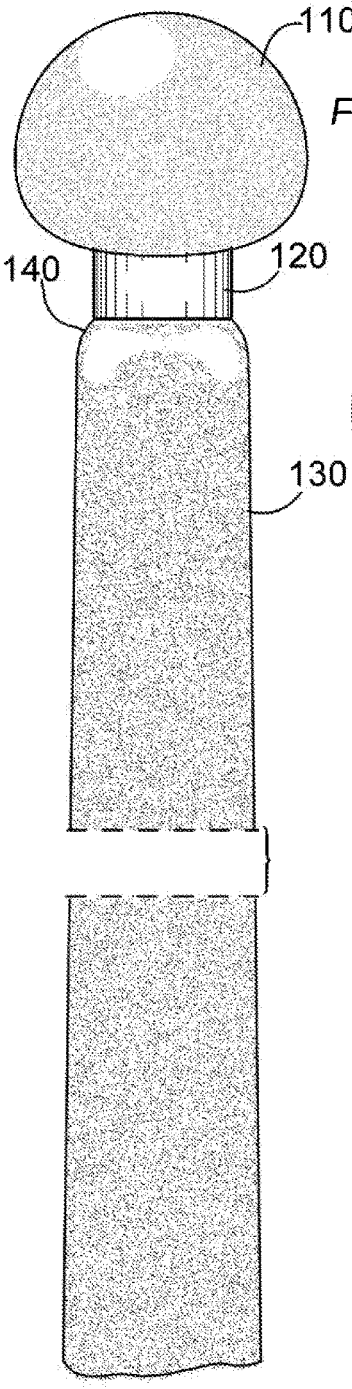
FIG. 4 shows a first side view of an embodiment according to the present invention.
Figure 6:
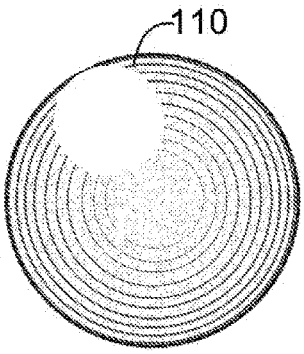
FIG. 6 shows an end view of the embodiment of (FIG. 4)
Figure 5:
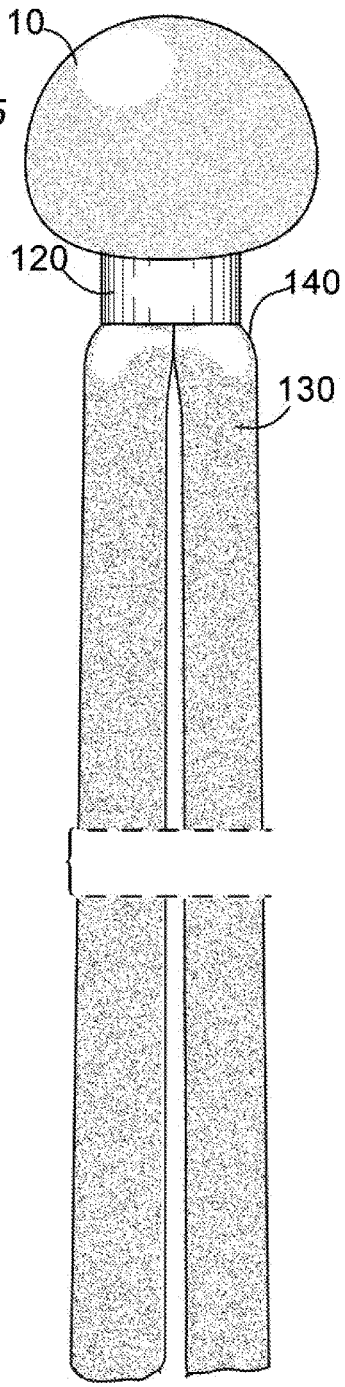
FIG. 5 shows a second side view of the embodiment of (FIG. 4)
Figure 10:
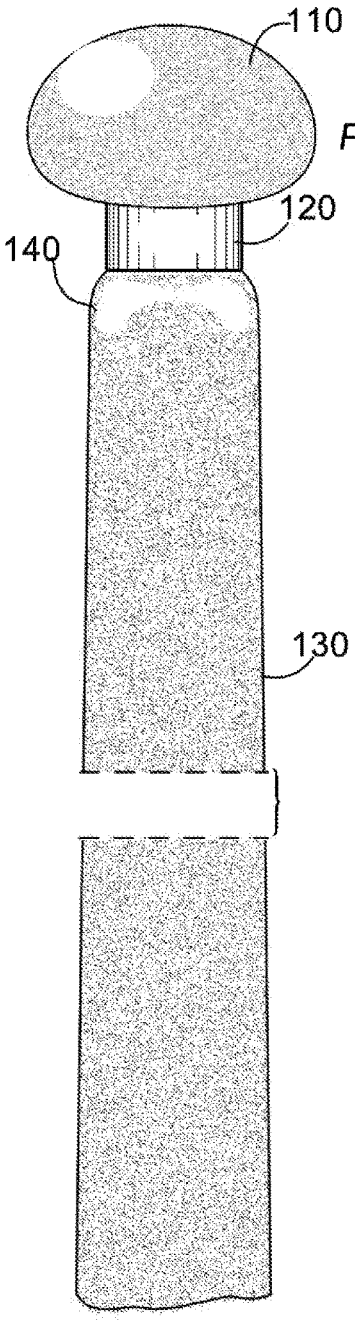
Figure 12:
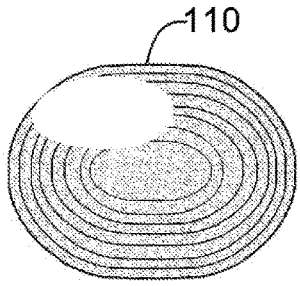
Figure 11:
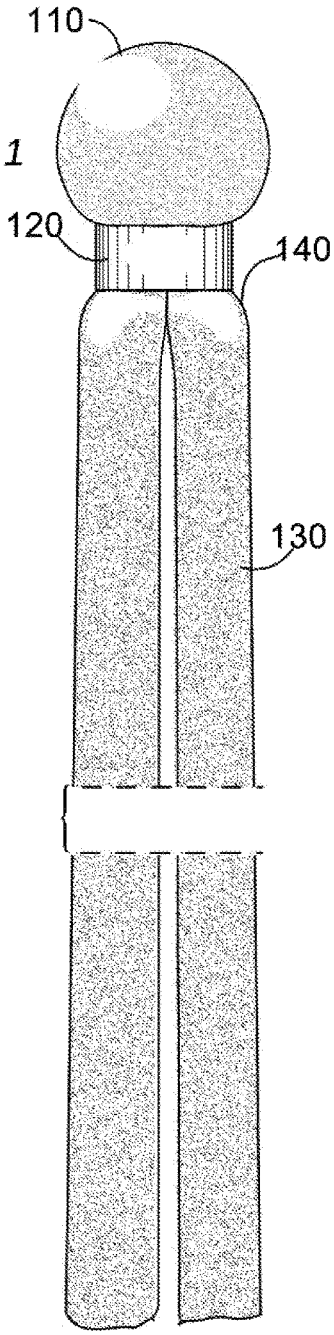
Figures 13, 14, 15, 16:
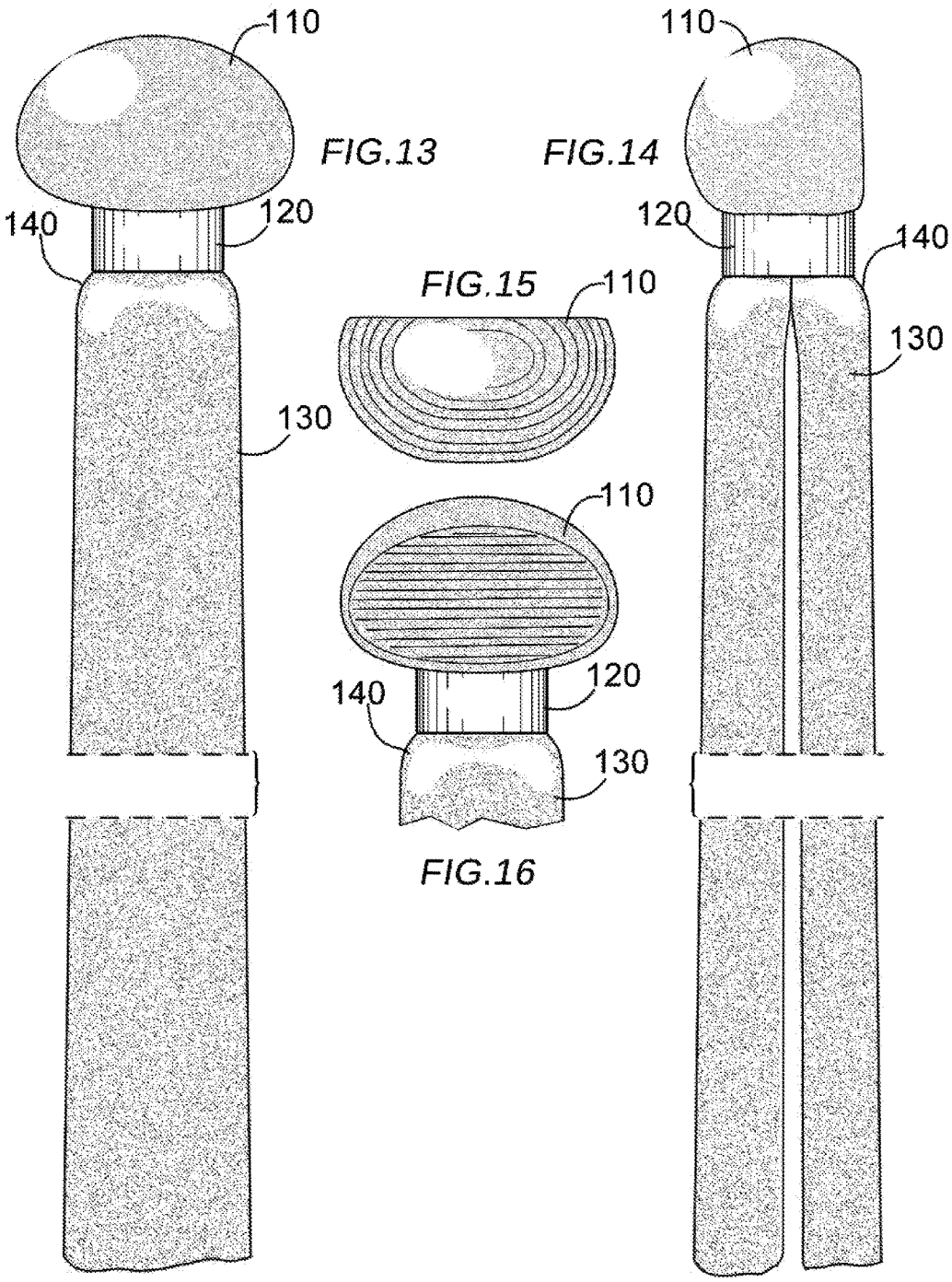
Figures 20, 21, 22A, 22B, 22C, 22D, 23, 24:
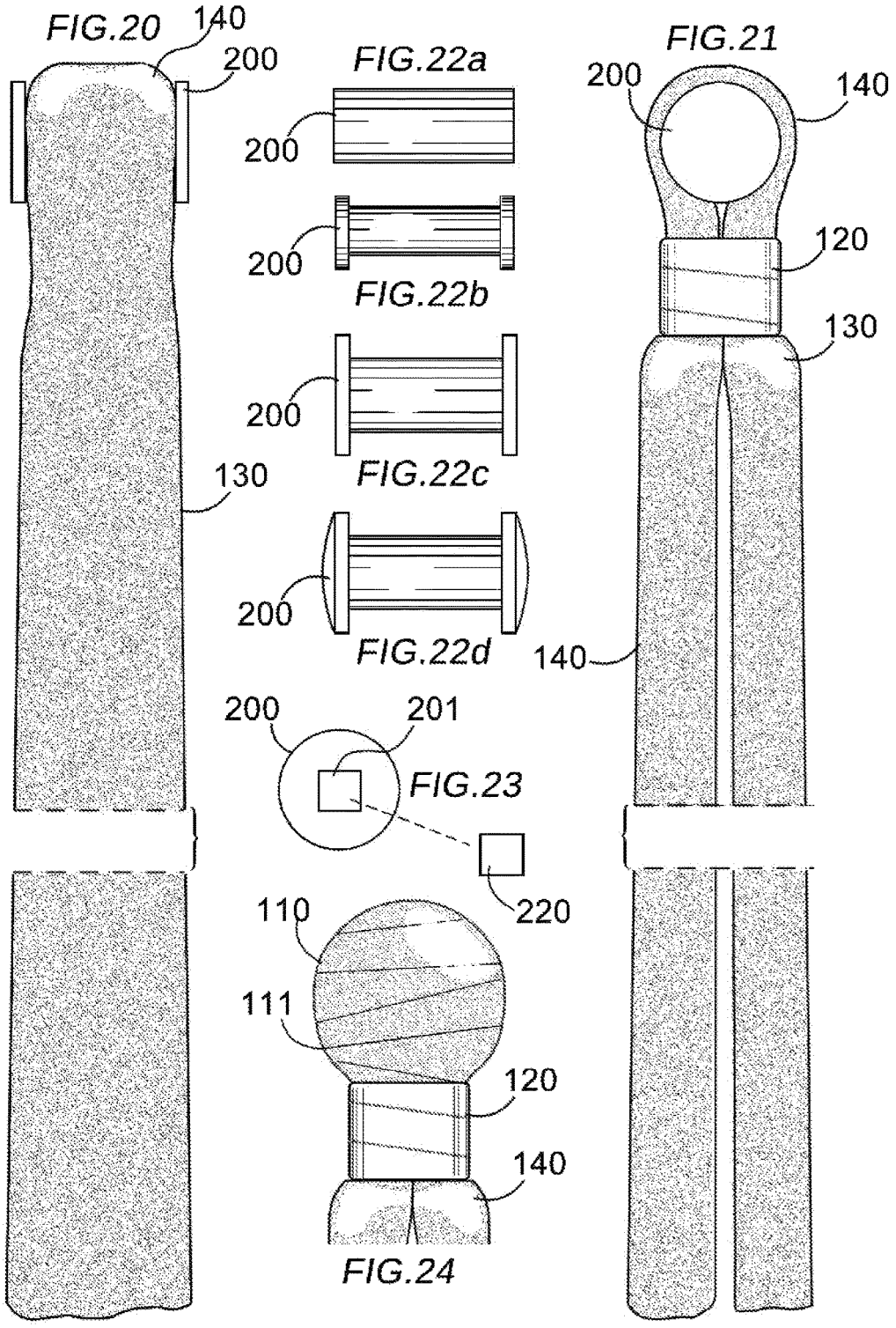
Figure 25:
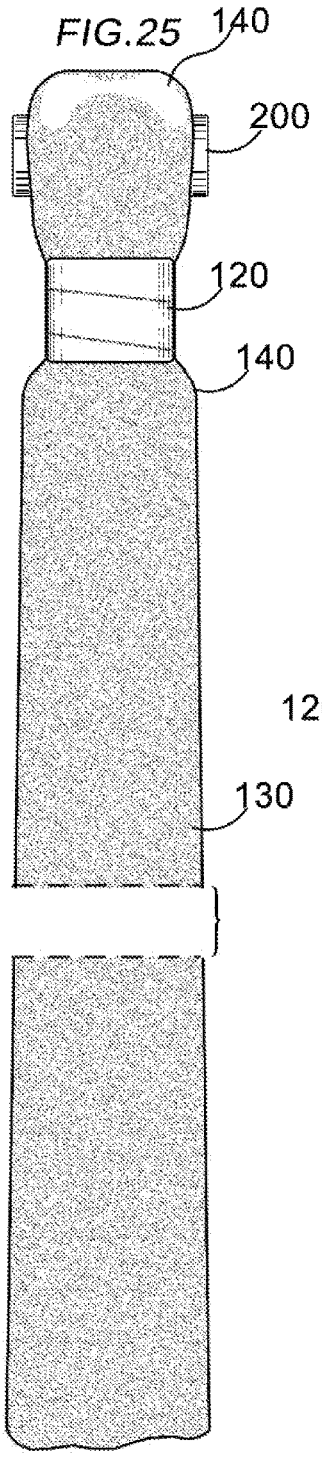
Figure 27:
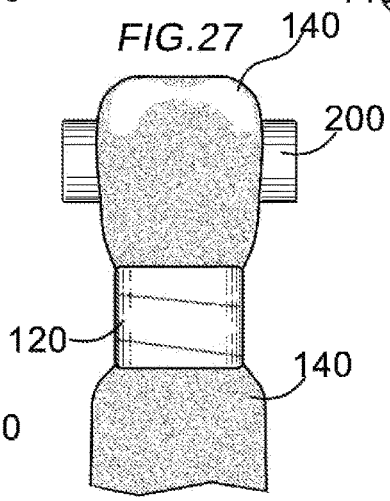
Figure 26:
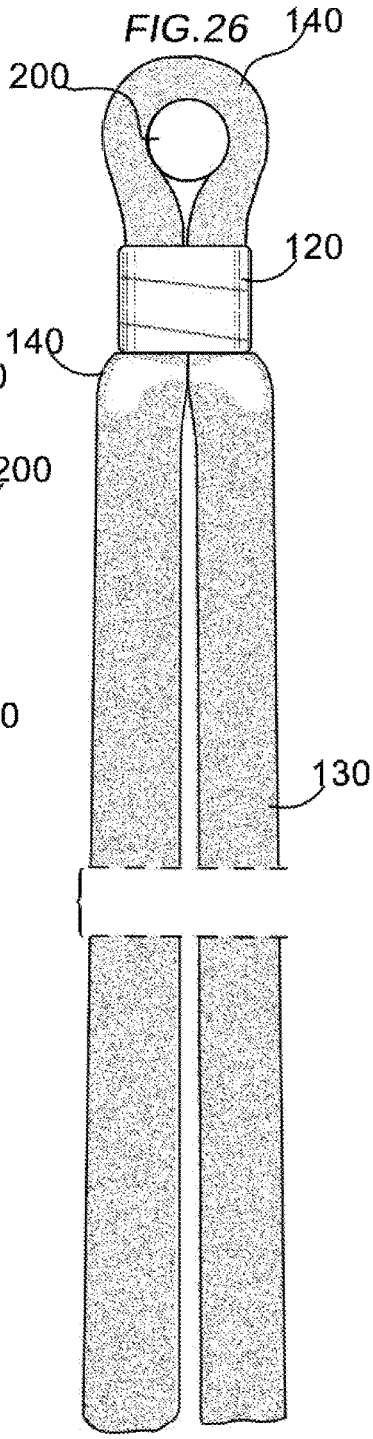
Figures 28, 29, 29A, 30, 31, 32:
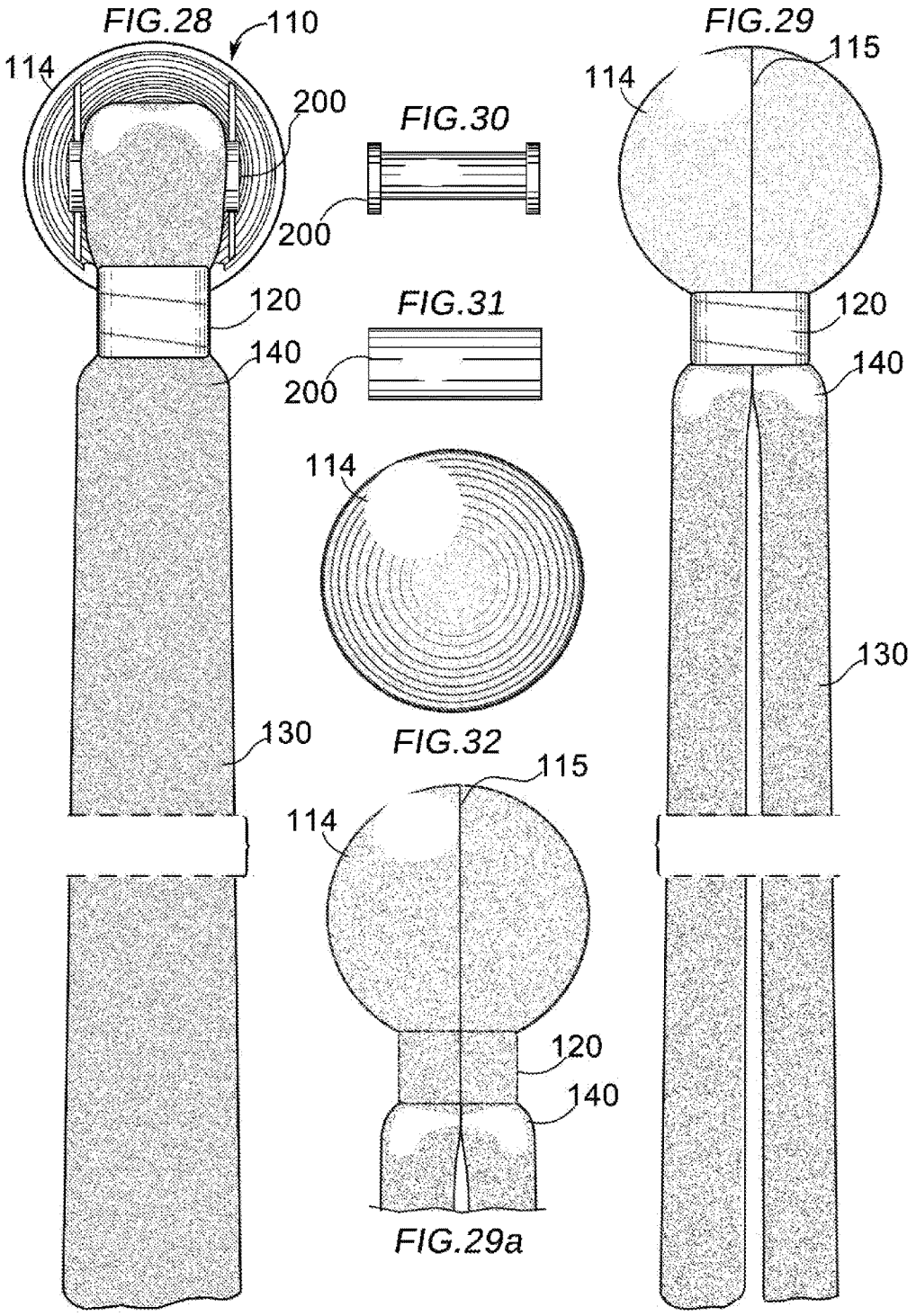
Figures 43, 44, 45, 46, 47, 48, 49, 50:
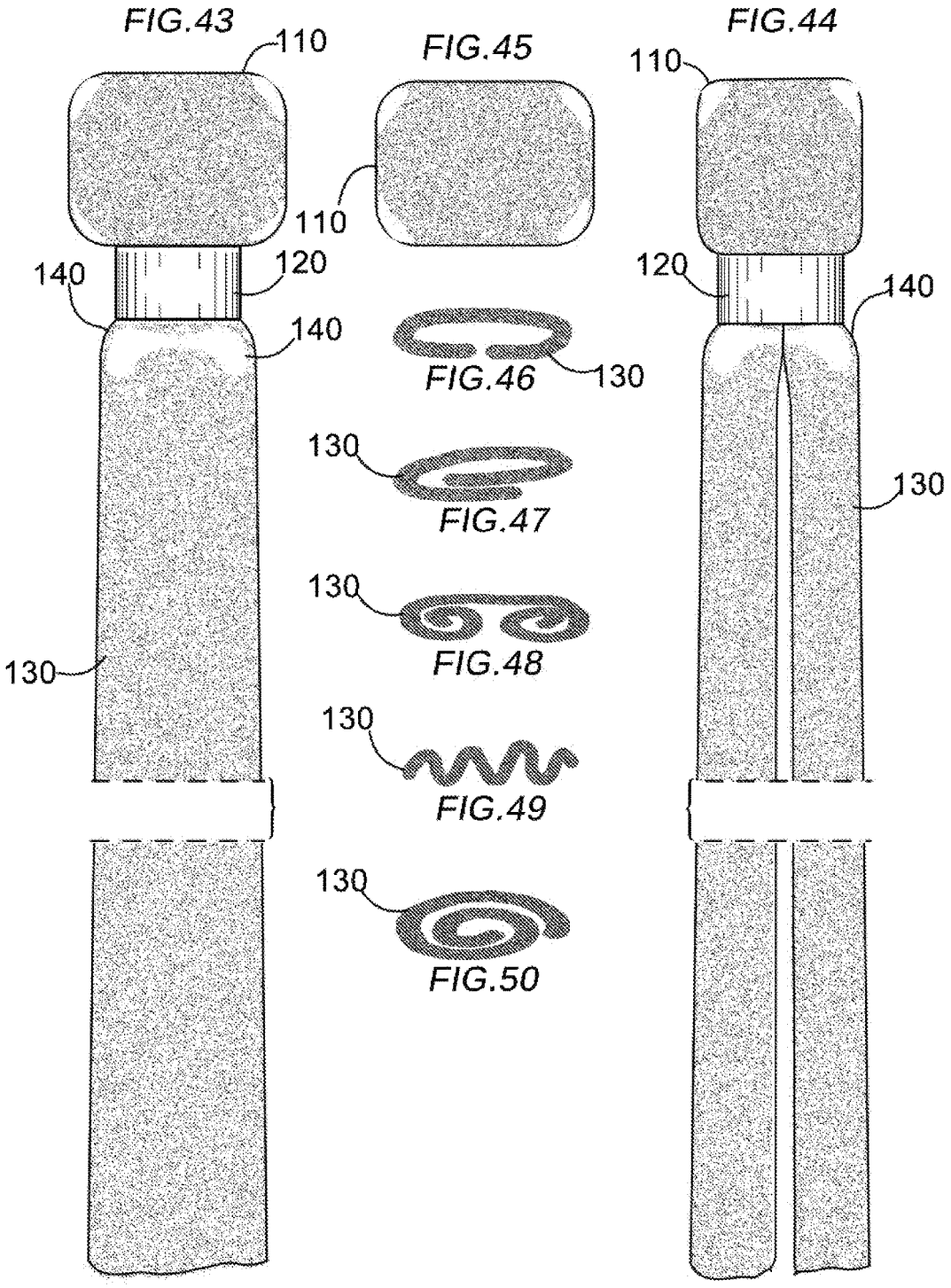

FIG. 8*a* shows an embodiment having a different shape for the nexus of the handle portion and the band portion;

FIG. 9 shows an end view of the embodiment of (FIG. 7);

FIG. 10 shows a first side view of an embodiment according to the present invention;

FIG. 11 shows a second side view of the embodiment of (FIG. 10);

FIG. 12 shows an end view of the embodiment of (FIG. 10);

FIG. 13 shows a first side view of an embodiment according to the present invention;

FIG. 14 shows a second side view of the embodiment of (FIG. 13);

FIG. 15 shows an end view of the embodiment of (FIG. 13);

FIG. 16 shows a third side view of an embodiment according to the present invention;

FIG. 17 shows a first side view of an embodiment according to the present invention;

FIG. 18 shows a second side view of the embodiment of (FIG. 17);

FIG. 19 shows an end view of the embodiment of (FIG. 17);

FIG. 20 shows a first side view of an embodiment according to the present invention;

FIG. 21 shows a second side view of the embodiment of (FIG. 20);

FIGS. 22*a*, 22*b*, 22*c* and 22*d* show side views of core 200;

FIG. 23 is an end view of an exemplary core with recces 201;

FIG. 24 shows another embodiment according to the present invention;

FIG. 25 is a first side view of an embodiment according to the present invention;

FIG. 26 is a second side view of the embodiment of (FIG. 25);

FIG. 27 is another side view of the embodiment of (FIG. 25) with extended core 200;

FIG. 28 is an interior view of one embodiment according to the present invention showing an outer shell 114, core 200 and towel 130 wrapped around the core;

FIG. 29 is a side exterior view of the embodiment of (FIG. 28);

FIG. 29*a* depicts an embodiment having a different shape for the nexus between the outer shell and the band portion;

FIGS. 30 and 31 illustrate exemplary cores 200;

FIG. 32 is an end view of the embodiment of (FIG. 29);

FIG. 33 shows a first side view of an embodiment according to the present invention;

FIG. 34 shows a second side view of the embodiment of (FIG. 33);

FIG. 35 is an end view of the embodiment of (FIG. 33);

FIGS. 36 and 37 show the embodiment of (FIG. 33) with a wrapped head;

FIG. 38 shows a first side view of an embodiment according to the present invention;

FIG. 39 shows a second side view of the embodiment of (FIG. 38);

FIG. 40 is an end view of the embodiment of (FIG. 38);

FIGS. 41 and 42 show the embodiment of (FIG. 38) with a wrapped head;

FIG. 43 shows a first side view of an embodiment according to the present invention;

FIG. 44 shows a second side view of the embodiment of (FIG. 43);

FIG. 45 is an end view of the embodiment of (FIG. 43);

FIGS. 46, 47, 48, 49 and 50 illustrate possible towel fold cross-sections taken through lines 2-2 of (FIG. 7).

REFERENCE LISTING OF THE NUMBERED ELEMENTS

100 trainer
110 head
111 wrap
114 shell
120 band
130 tail
140 shoulder
150 tail end(s)
200 core
201 recess
220 chip

Definitions

In the following description, the term "chip" refers to any circuit that may include a microprocessor, volatile and/or non-volatile memory, an accelerometer component, a transceiver, a data logging component, a port and a sound emitting means. Unless otherwise explained, any technical terms used herein have the same meaning as commonly understood by one of ordinary skill in the art to which this disclosure belongs. The singular terms "a", "an", and "the" include plural referents unless the context clearly indicates otherwise. Similarly, the word "or" is intended to include "and" unless the context clearly indicates otherwise. Although methods and materials similar or equivalent to those described herein can be used in the practice or testing of this disclosure, suitable methods and materials are described below. The term "comprises"means "includes". All publications, patent applications, patents, and other references mentioned herein are incorporated by reference in their entirety for all purposes. In case of conflict, the present specification, including explanations of terms, will control. In addition, the materials, methods, and examples are illustrative only and not intended to be limiting. It should be understood that objects, features and aspects of any described embodiment may be combined with any other disclosed embodiment.

Referring generally to FIGS. 1-50, embodiments according to the present invention for a towel trainer 100 include, a head portion 110, a core portion 200, a tail portion 130 that includes a hand towel or the like, and, a band portion 120 at the junction of the tail and head portions. In some embodiments the head portion is a medial portion of a folded towel looped around a core which may be a cylindrical member or another shape that may be weighted or configured to contain a chip or circuit that logs or transmits motion data. Wrapping 111 if any is present, around the tail end and core, can be any pliant material that is capable of covering the head, such as tape or fabric. Band 120 can be a molded tubular sleeve through which the tail portion is threaded, or the band may be composed of tape or wrapping where the tail portion transitions to the head portion. Alternately, the band may have a clam-shell configuration having pieces that snap together around the tail portion. Preferably, the band is from 1 inch to 1.5 inches in width, and 0.875 inches to 1 inch in length. If the band is wound construction, preferably, the windings comprise a thick tape that creates a "flex" between the head and tail and forms a whip-like construction for a user's fingers to rest around, or, in cases where the band is molded, it may be comprised of an elastomeric tubing. In some embodiments, the head portion includes a shell that covers interior core and tail portions, and provides for tail and core replacement. FIG. 28, in an exemplary embodiment, shows the core 200 and tail portions 130 fitted inside of shell 114. Although a spherical clam-shell configuration is depicted, other shapes and configurations for two-part or multi-part shells will suggest themselves to those having skill in the art. The shell may be hard, soft, covered in an elastomer, or include foam or fabric and batting. The juncture between the band and the head may be centered or offset as depicted in (FIGS. 33-37). Conceivably, the band and the head may be molded in one piece so that both are applied around the tail with a clam-shell snap fit (FIGS. 29, 29*a*). Preferably, the exposed length of tail 130 may vary anywhere between 8 and 18 inches, and can possess folds in numerous configurations, as shown in (FIGS. 46-50). The tail ends can be hemmed or include fringe or crackers (not shown) like a bull-whip.

In order to replace the tail portion, the forward end of the towel must be exposed, and, the core and band removed. The towel and core portions of the trainer composing the handle portion may be unwrapped or lack a clam-shell covering. The core may be a simple cylinder, capped at the ends e.g., (FIGS. 22B, 22*c*, 22*d*), or, rounded so that the towel ends looped around the core conform to the core's shape. The core may include a recess 201 for receiving a motion sensing circuit 220 and batteries (not shown) to power the circuit, or, the recess may also be used to house small weights if desired.

Tail folds e.g., (FIGS. 46, 47, 48, 49 and 50), can be varied as desired, from dense and tightly folded, in coils or loops or accordion folded. Whatever the case, band 120 is sufficiently tight serves to secure the particular fold in place.

The head portion may be spheroid, elliptical, faceted and/or may possess flattened sections FIGS. 17-19).

It should be understood that the drawings and detailed description herein are to be regarded in an illustrative rather than a restrictive manner, and are not intended to be limiting to the particular forms and examples disclosed. Accordingly, it is intended that this disclosure encompass any further modifications, changes, rearrangements, substitutions, alternatives, design choices, and embodiments as would be appreciated by those of ordinary skill in the art having benefit of this disclosure, and falling within the scope of the following claims.

What is claimed is:

1. A hand held towel trainer comprising: (1) a bulbous handle over a core portion, the bulbous handle including a top portion and a bottom portion, wherein the top portion has a substantially rounded shape; (2) a towel portion forming a pair of tails including a first tail and a second tail, each tail including a width and a length configured to exceed the width, the length of the first tail and second tail being substantially the same length and the width of the first tail and second tail being substantially the same width, each tail folded lengthwise and configured to extend from the bottom portion of the bulbous handle, the first tail and second tail are coupled to the core portion and encapsulated by the bulbous handle, the pair of tails configured to provide an audible snapping sound when the towel trainer is moved in accordance with a training exercise; and, (3) a reversibly attached flexible band around the pair of tails, the flexible band configured to abut the bottom portion of the bulbous handle and configured to fit between fingers of a user, and, wherein borders of the first tail and second tail are substantially non-contiguous at least in portions of the first tail and second tail that extend below the flexible band.

2. The towel trainer according to claim 1, wherein the pair of tails is secured within the handle by the core portion.

3. The towel trainer according to claim 1 wherein the core portion is reversibly insertable.

4. The towel trainer according to claim 1 including a motion sensing means for determining acceleration of the handle or tails.

5. The towel trainer according to claim 1 further comprising a clam-shell covering.

6. The towel trainer according to claim 1 further comprising an accelerometer.

7. The towel trainer according to claim 1, wherein the band is reversibly attachable around the tails.

8. A method of making a towel trainer comprising the steps of: providing a hand towel, a core, and a band; folding the towel medially and lengthwiseso that it wraps around the core and produces a first branch and a second branch of a tail, each branch of the tail having a width and a length configured to exceed the width, the length of the first branch and second branch being substantially the same length and the width of the first branch and second branch being substantially the same width and wherein the branches are at least 8 inches in length and extend from the core and the branches are configured to provide an audible snapping sound when the towel trainer is moved in accordance with a training exercise; applying a band around the tail and a junction between the tail and the core such that the core and towel are cinched together; encapsulating portions of the towel trainer above the band to form a handle, and wherein each branch of the tail has a peripheral border, and configuring the tail such that the peripheral borders are non-contiguous in tail portions extending below the band.

* * * * *